US005713798A

United States Patent [19]

Brodie, Jr.

[11] Patent Number: 5,713,798

[45] Date of Patent: Feb. 3, 1998

[54] BOWLER'S TRAINING DEVICE

[76] Inventor: Cary Brodie, Jr., 3500 Palm Ct. Apt. 301, Raleigh, N.C. 26707-3435

[21] Appl. No.: 791,660

[22] Filed: Jan. 30, 1997

[51] Int. Cl.[6] ..... A63D 5/04

[52] U.S. Cl. ..... 473/55; 473/58

[58] Field of Search ..... 473/55, 58

[56] References Cited

U.S. PATENT DOCUMENTS

| | | | |
|---|---|---|---|
| 3,058,746 | 10/1962 | Ober | 473/58 |
| 3,250,535 | 5/1966 | Patterson et al. | 473/58 |
| 3,252,705 | 5/1966 | Cornberg | 473/58 |
| 3,301,558 | 1/1967 | Clapham | 473/58 |
| 4,607,843 | 8/1986 | Signoretti | 473/58 |
| 5,626,523 | 5/1997 | Mowers et al. | 473/58 |

*Primary Examiner*—William M. Pierce

[57] ABSTRACT

A new Bowler's Training Device for helping a bowler roll higher scores. The inventive device includes a housing disposed above the surface of the lane, a first adjustable light emitting device in the housing emitting a light beam onto the lane providing a ball lay down indicating point, and a second adjustable light emitting device in the housing emitting a light beam onto the lane providing an indicating line indicating the bowling ball travel path.

13 Claims, 4 Drawing Sheets

FIG. 3
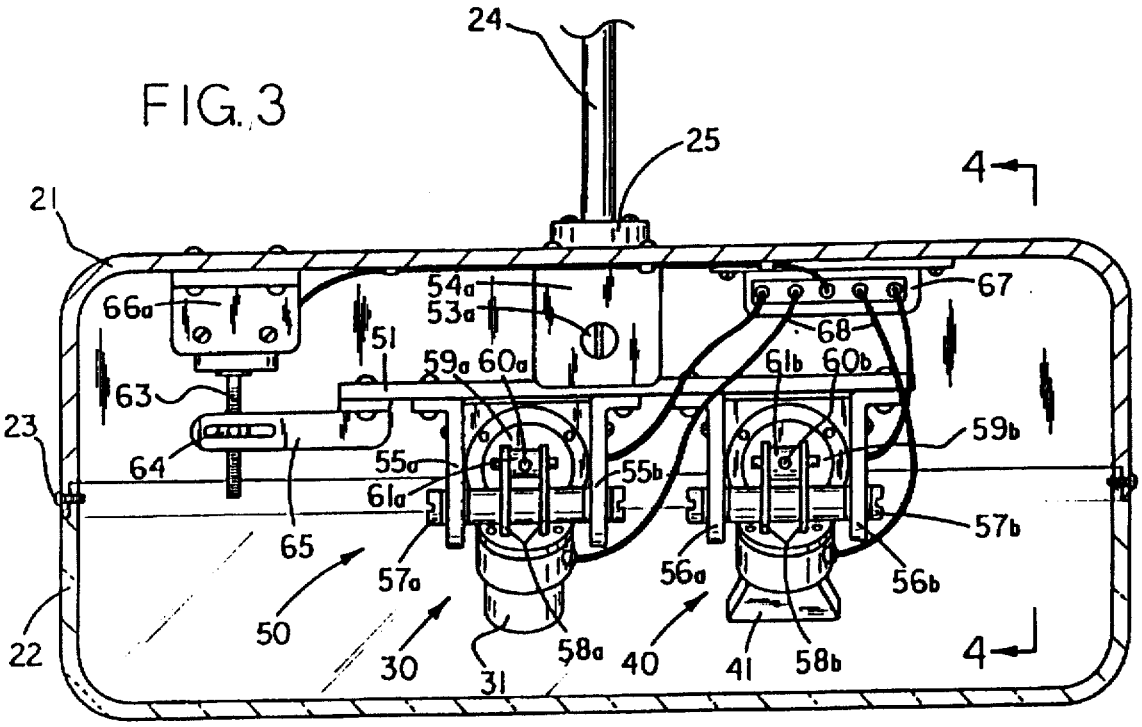
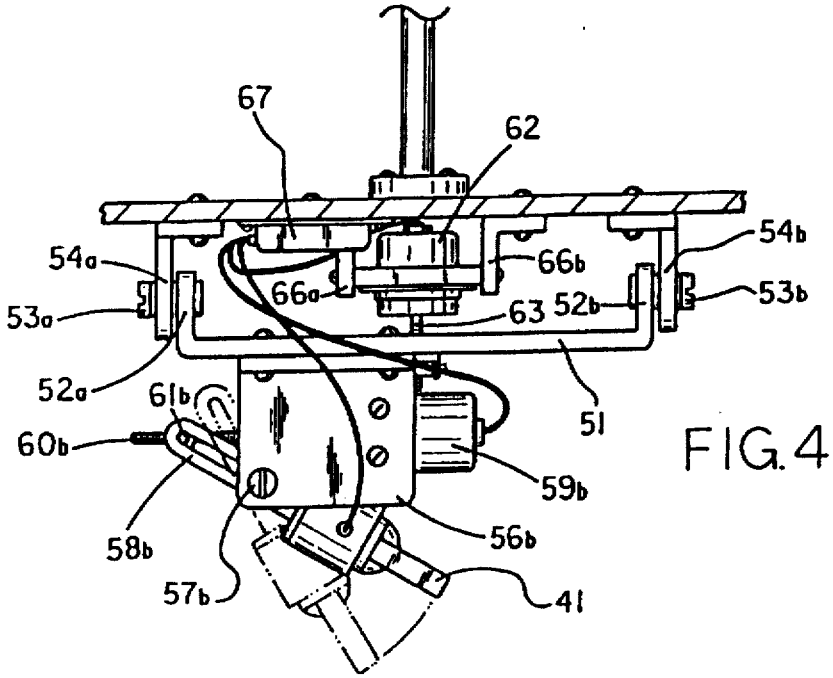
FIG. 4

BOWLER'S TRAINING DEVICE

BACKGROUND OF THE INVENTION

1. Field of the Invention

The present invention relates to bowling training aids and more particularly pertains to a new Bowler's Training Device for helping a bowler roll higher scores.

2. Description of the Prior Art

The use of bowling training aids is known in the prior art. More specifically, bowling training aids heretofore devised and utilized are known to consist basically of familiar, expected and obvious structural configurations, notwithstanding the myriad of designs encompassed by the crowded prior art which have been developed for the fulfillment of countless objectives and requirements.

Known prior art bowling training aids include U.S. Pat. No. 4,607,843; U.S. Pat. No. 4,773,644; U.S. Pat. No. 4,339,128; U.S. Pat. No. 4,302,010; U.S. Pat. Des. 246,675 and U.S. Pat. No. 5,413,533.

While these devices fulfill their respective, particular objectives and requirements, the aforementioned patents do not disclose a new Bowler's Training Device. The inventive device includes a housing disposed above the surface of the lane, a first adjustable light emitting device in the housing emitting a light beam onto the lane providing a ball lay down indicating point, and a second adjustable light emitting device in the housing emitting a light beam onto the lane providing an indicating line indicating the bowling ball travel path.

In these respects, the Bowler's Training Device according to the present invention substantially departs from the conventional concepts and designs of the prior art, and in so doing provides an apparatus primarily developed for the purpose of helping a bowler roll higher scores.

SUMMARY OF THE INVENTION

In view of the foregoing disadvantages inherent in the known types of bowling training aids now present in the prior art, the present invention provides a new Bowler's Training Device construction wherein the same can be utilized for helping a bowler roll higher scores.

The general purpose of the present invention, which will be described subsequently in greater detail, is to provide a new Bowler's Training Device apparatus and method which has many of the advantages of the bowling training aids mentioned heretofore and many novel features that result in a new Bowler's Training Device which is not anticipated, rendered obvious, suggested, or even implied by any of the prior art bowling training aids, either alone or in any combination thereof.

To attain this, the present invention generally comprises a housing disposed above the surface of the lane, a first adjustable light emitting device in the housing emitting a light beam onto the lane providing a ball lay down indicating point, and a second adjustable light emitting device in the housing emitting a light beam onto the lane providing an indicating line indicating the bowling ball travel path.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Bowler's Training Device apparatus and method which has many of the advantages of the bowling training aids mentioned heretofore and many novel features that result in a new Bowler's Training Device which is not anticipated, rendered obvious, suggested, or even implied by any of the prior art bowling training aids, either alone or in any combination thereof.

It is another object of the present invention to provide a new Bowler's Training Device which may be easily and efficiently manufactured and marketed.

It is a further object of the present invention to provide a new Bowler's Training Device which is of a durable and reliable construction.

An even further object of the present invention is to provide a new Bowler's Training Device which is susceptible of a low cost of manufacture with regard to both materials and labor, and which accordingly is then susceptible of low prices of sale to the consuming public, thereby making such Bowler's Training Device economically available to the buying public.

Still yet another object of the present invention is to provide a new Bowler's Training Device which provides in the apparatuses and methods of the prior art some of the advantages thereof, while simultaneously overcoming some of the disadvantages normally associated therewith.

Still another object of the present invention is to provide a new Bowler's Training Device for helping a bowler roll higher scores.

Yet another object of the present invention is to provide a new Bowler's Training Device which includes a housing disposed above the surface of the lane, a first adjustable light emitting device in the housing emitting a light beam onto the lane providing a ball lay down indicating point, and a second adjustable light emitting device in the housing emitting a light beam onto the lane providing an indicating line indicating the bowling ball travel path.

Still yet another object of the present invention is to provide a new Bowler's Training Device that gives a unique and easy target to focus on before releasing the ball.

Even still another object of the present invention is to provide a new Bowler's Training Device that allows a beginning bowler to quickly improve with less pressure and intimidation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a sectional view of the housing along lines 3—3 of FIG. 2.

FIG. 4 is a partial sectional view along lines 4—4 of FIG. 3.

DESCRIPTION OF THE PREFERRED EMBODIMENT

Figure 1:
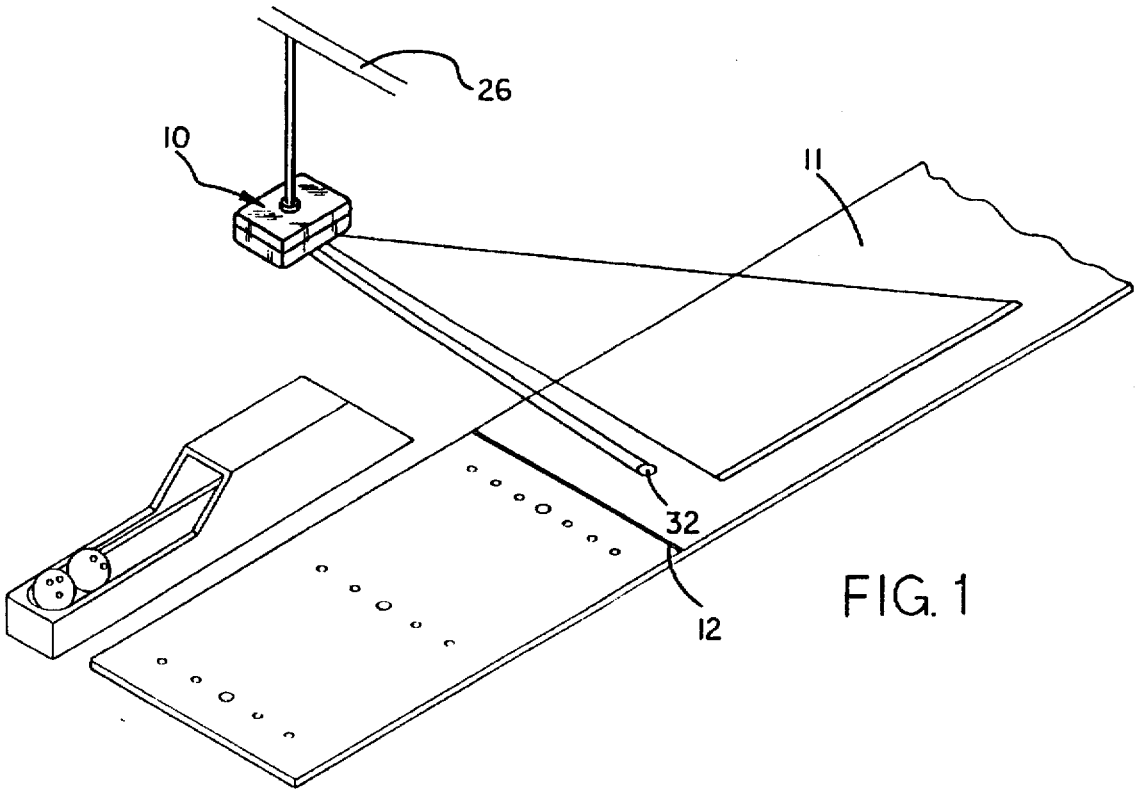
FIG. 1 is a right side perspective view of a new Bowler's Training Device according to the present invention.
Figure 2:
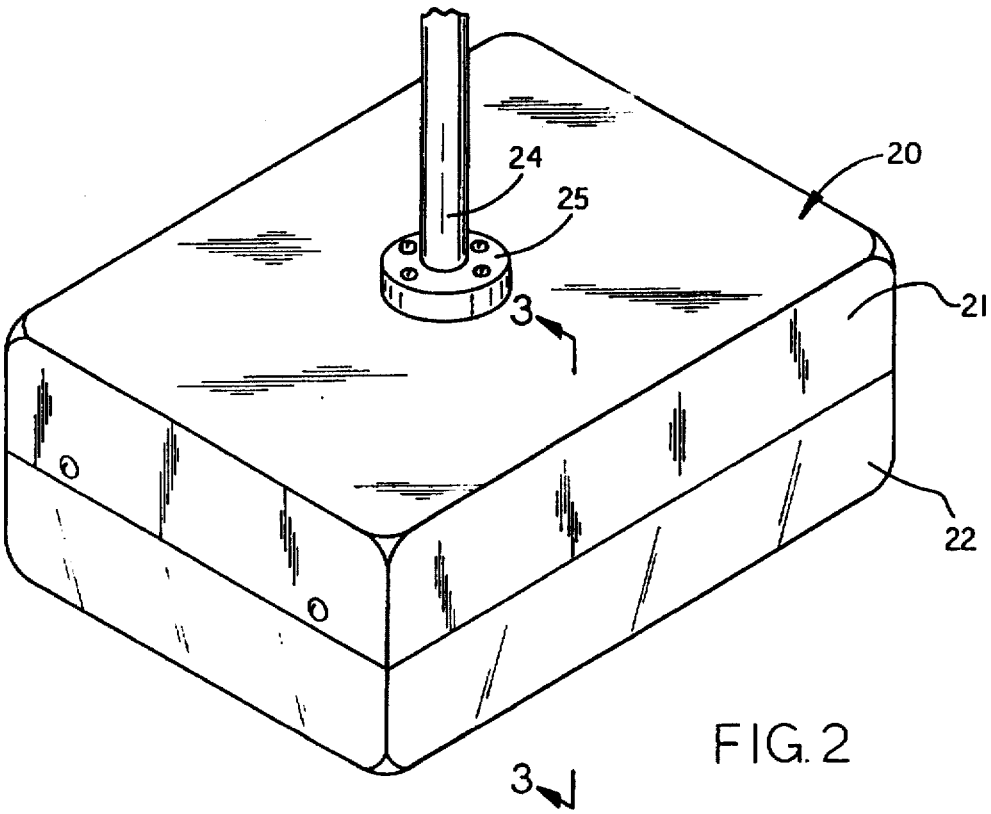
FIG. 2 is a side elevation view of the housing for the light emitting devices.
Figure 5:
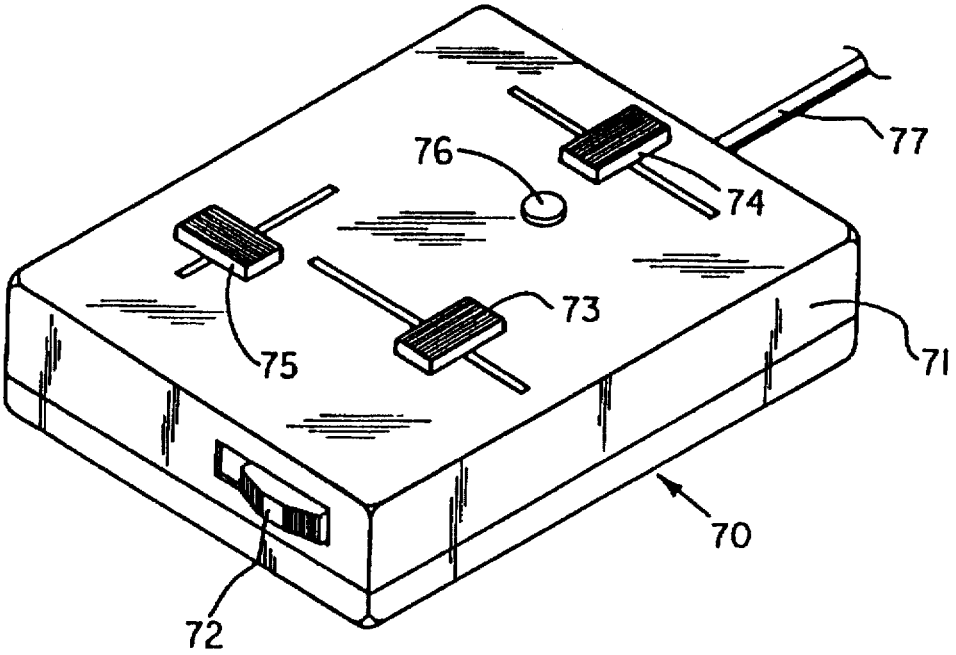
FIG. 5 is a perspective view of the remote control unit controlling movements of the lights.
Figure 6:
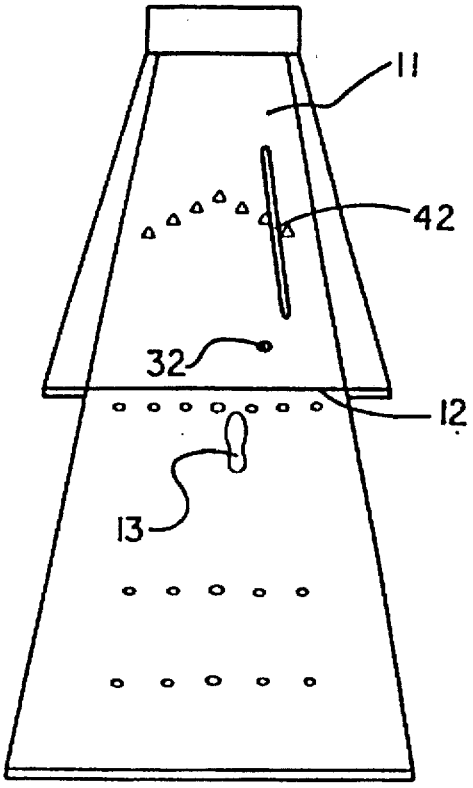
FIG. 6 is a view looking down the lane showing the location of the indicating lights, relative to the foul line and finish point of the sliding foot.
Figure 7:
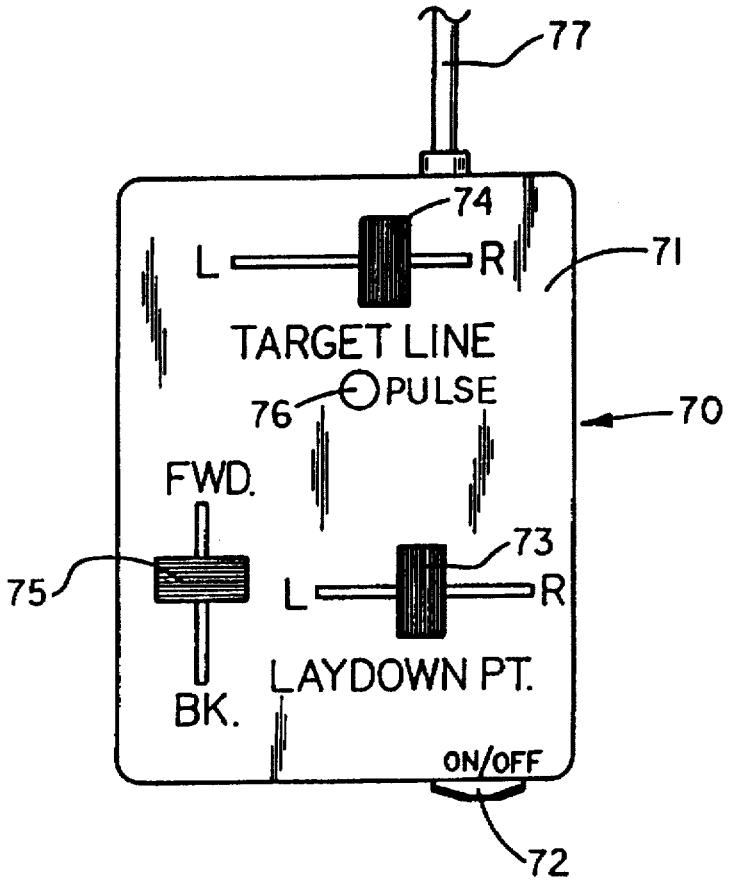
FIG. 7 is a top view of the remote control unit.
Figure 8:
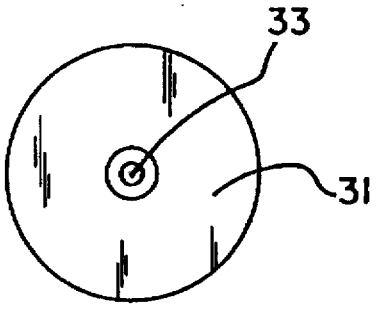
FIG. 8 is a bottom view of the lens on the first light emitter.
Figure 9:
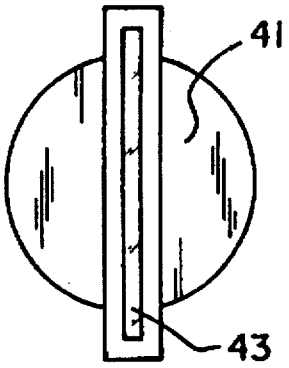
FIG. 9 is a bottom view of the lens on the second light emitter.

With reference now to the drawings, and in particular to FIGS. 1 through 9 thereof, a new Bowler's Training Device embodying the principles and concepts of the present invention and generally designated by the reference numeral 10 will be described.

More specifically, it will be noted that the Bowler's Training Device 10 comprises a housing 20, a first light emitting means 30, a second light emitting means 40, adjustment means 50 for adjusting the light emitting means, and a control unit 70 for controlling the adjustment means.

As best illustrated in FIGS. 1 through 9, it can be shown that the housing 20 comprises two halves, upper half 21 and lower half 22, secured together using screws 23 or other fasteners. The housing is supported above the surface of the bowling lane 11 having a foul line 12, by a downrod 24 extending from the ceiling 26 or other suitable overhead support. The downrod is attached to the housing using suitable attachment means 25. The lower housing half 22 is formed of a clear material, such as glass or clear plastic, in order to allow light to pass through the lower housing half. Alternatively, the lower housing half could be formed of opaque material, but have apertures in the bottom wall to allow light to exit the lower housing half. The housing is illustrated as being rectangular in shape, however other shapes could be utilized. Additionally, the housing could be supported above the surface of the lane in other ways, so long as the light beams, to be described later, are able to be projected onto the lane.

Disposed within the housing are first 30 and second 40 light emitting means for emitting first and second light beams onto the lane 11. The first light emitting means includes a first light unit 31 emitting a beam so as to form a visual indicating point 32 on the lane. The light unit 31 includes a circular lens 33 for emitting a circular beam of light. The second light emitting means includes a second light unit 41 emitting a beam so as to form a visual indicating line 42 on the lane, parallel to the length of the lane. The light unit 41 includes a rectangular lens 43 for emitting a rectangular beam of light. The light units can provide steady light, such as from incandescent bulbs, or provide pulsing light beams, such as from lasers. Additionally, either one, or both, of the light units can provide steady/pulsating light.

The light units 31,41 are supported by the adjustment means 50 for adjusting the light units. The adjustment means 50 includes a tilt table 51 having two upright ears 52*a*,52*b*. Brackets 54*a*,54*b* extend down from the top of the housing on either side of the ears 52*a*,52*b*, and pivots 53*a*,53*b* pivotally attach the ears and brackets, in order to permit pivoting movements of the tilt table about the pivots 53*a*, 53*b*. Extending downward from the tilt table 51 are support ears 55*a*,55*b* for the light unit 31 and support ears 56*a*,56*b* for the light unit 41.

The light unit 31 is pivotally attached to the support ears 55*a*,55*b* through pivot 57*a*. Electric motor 59*a* is also attached to the support ears 55*a*,55*b*. The electric motor rotates a drive shaft 60*a* which translates a nut 61*a*. The nut 61*a* is attached to the pivot 57*a* through drive arms 58*a*, such that rotation of the shaft 60*a* translates the nut 61*a*, which rotates the arms 58*a* and pivot 57*a*, thus resulting in pivoting of the light unit 31. The light unit 41 is supported and adjusted similarly to the light unit 31, and no further explanation for light unit 41 is provided. Similar elements for light unit 41 have been labeled with the letter "b" in place of the letter "a" used for light unit 31.

The tilt table 51 is itself pivoted by a drive motor 62 attached to the housing by brackets 66*a*,66*b*. The drive motor 62 rotates a drive shaft 63, which causes nut 64 to translate along drive shaft 63. The nut 64 is attached to drive arms 65 which are attached to the table. Thus, rotation of the drive shaft 63 moves the nut 64 up and down along the shaft, which causes the arms 65 to pivot the tilt table 51 about the pivots 53*a*,53*b*. Since both light units 31,41 are attached to the tilt table, each light unit will move with the table 51.

Power for powering the light units 31,41 and motors 59*a*,59*b*,62 is supplied through an electronics module 67 disposed inside the housing and wiring 68 extending from the module to the light units and motors.

From the above description, and referring to FIGS. 1 and 3–4, it is clear that motors 59*a*,59*b* individually adjust the light units 31,41 so as to adjust the position of the indicators 32,42 left and right along the foul line 12. Motor 62 simultaneously adjusts both indicators 32,42 closer to or farther away from the foul line 12.

Control unit 70 is used to control the positioning of the light beams on the lane. Control unit 70 includes a box-like housing 71 which can be mounted near the bowler, such as at a scoring table or on the ball return unit, or it can be a hand held device. The housing 71 includes an on/off switch 72 for selectively powering the training device. The housing also includes a control slide 73 for adjusting the left/right location of the indicating point 32, a control slide 74 for adjusting the left/right location of the indicating line 42, and a control slide 75 for adjusting the forward/backward location of the indicating point 32 and indicating line 42. A pulse button 76 is also provided in order to select pulsing light beams. A control cable 77 leads from the unit 70 to the electronic module 67, in order to carry control signals from the control unit to the module and from there to the respective light unit or motor. The specific circuitry within the control unit 70 for generating control signals based upon the locations of the slides 73–75 and actuation of the pulse button 76 would be apparent to one having ordinary skill in the art, and is therefore not further described.

In use, a bowler first experimentally determines his/her consistent approach track and the location of the finish point 13 of the sliding foot (which is the left foot for a right-handed bowler). Once the finish point 13 is determined, the user adjusts the first light unit 31 so that the indicating point 32 is located about 3.0 to 4.5 inches to the side of the finish point and from about 3.0 inches to 3.0 feet beyond the foul line. The second light unit 41 is also adjusted so that the indicating line is about 3.0 to 12.0 inches to the side of the finish point and up to 30.0 feet beyond the foul line. The user is now ready to bowl, with the indicating point 32 providing a reference where the ball should be initially dropped, and the indicating line 42 providing a reference on the path the ball should travel to the pins.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Bowler's Training Device used in combination with a bowling lane having a foul line, comprising:

a housing means disposed above a surface of the lane;

a first light emitting means disposed in the housing means for emitting a first light beam onto the surface, said first light beam forming a visual indicating point on the lane at a predetermined location relative to the foul line indicating a point where the bowler should lay down a bowling ball;

a second light emitting means disposed in the housing means for emitting a second light beam onto the surface, said second light beam forming an elongated, visual indicating line at a predetermined location relative to the foul line indicating a path a bowling ball should travel.

2. The Bowler's Training Device of claim 1, wherein at least one of the light emitting means is adjustable to vary the location of the respective light beam on the surface.

3. The Bowler's Training Device of claim 2, wherein the first and second light emitting means are adjustable.

4. The Bowler's Training Device of claim 3, wherein the first and second light emitting means are adjusted by adjustment means located within the housing means.

5. The Bowler's Training Device of claim 4, further comprising a remote control unit in electrical communication with the adjustment means for selectively adjusting the first and second light emitting means.

6. The Bowler's Training Device of claim 4, wherein the adjustment means controls forward and backward movements, and left and right movements, of the first and second light emitting means in the housing means and first and second light beams on the surface.

7. The Bowler's Training Device of claim 1, wherein at least one of the light beams pulsates.

8. The Bowler's Training Device of claim 7, wherein the first and second light beams pulsate.

9. The Bowler's Training Device of claim 7, wherein the pulsating light beam is generated by a laser.

10. The Bowler's Training Device of claim 1, wherein at least one of the light beams is a continuous beam.

11. The Bowler's Training Device of claim 10, wherein the first and second light beams are continuous beams.

12. A Bowler's Training Device used in combination with a bowling lane having a foul line, comprising:

a housing disposed above a surface of the lane;

a first adjustable light emitting device disposed in the housing for emitting a first adjustable light beam onto the surface, said first adjustable light beam forming a visual indicating point on the surface at a distance between 3.0 inches to 3.0 feet from the foul line indicating a point whore a bowler should lay down a bowling ball;

a second adjustable light emitting device disposed in the housing for emitting a second adjustable light beam onto the surface, said second adjustable light beam forming an elongated, visual indicating line extending up to 30.0 feet from the indicating point, indicating a path a bowling ball should travel;

said first and second light emitting devices being adjusted by adjustment devices located within the housing, said adjustment devices being controlled by a remote control unit in electrical communication with the adjustment devices, said adjustment devices controlling forward and backward movements, and left and right movements, of the first and second light emitting devices in the housing means and first and second light beams on the surface.

13. A method of operating a bowler's training device used in combination with a bowling lane having a foul line, the training device including a housing disposed above the lane, a first adjustable light emitting device disposed in the housing for emitting a first adjustable light beam onto the lane, the first adjustable light beam forming a visual indicating point on the lane indicating a point where a bowler should lay down a bowling ball, a second adjustable light emitting device disposed in the housing for emitting a second adjustable light beam onto the lane, said second adjustable light beam forming an elongated, visual indicating line on the lane indicating a path a bowling ball should travel, the method comprising:

determining a finish point of a sliding foot of an individual bowler;

adjusting the first light emitting device so that the indicating point is located from about 3.0 to 4.5 inches to a side of the finish point and from about 3.0 inches to 3.0 feet beyond the foul line;

adjusting the second light emitting device so that the indicating line is located in line with the indicating point and approximately 3.0–12.0 inches to a side of the finish point and up to 30.0 feet from the foul line.

* * * * *